US008721248B2

(12) United States Patent
Jonsson

(10) Patent No.: US 8,721,248 B2
(45) Date of Patent: May 13, 2014

(54) ROTATOR

(75) Inventor: Anders Jonsson, Vindeln (SE)

(73) Assignee: Indexator Group Ab, Vindeln (SE)

( * ) Notice: Subject to any disclaimer, the term of this patent is extended or adjusted under 35 U.S.C. 154(b) by 3493 days.

(21) Appl. No.: 10/502,017

(22) PCT Filed: Jan. 17, 2003

(86) PCT No.: PCT/SE03/00049
§ 371 (c)(1),
(2), (4) Date: Dec. 17, 2004

(87) PCT Pub. No.: WO03/068655
PCT Pub. Date: Aug. 21, 2003

(65) Prior Publication Data

US 2005/0105240 A1 May 19, 2005

(30) Foreign Application Priority Data

Jan. 21, 2002 (SE) ..... 02001683

(51) Int. Cl.
*A01G 23/00* (2006.01)

(52) U.S. Cl.
USPC ..... 414/23; 294/82.15; 212/242

(58) Field of Classification Search
USPC ..... 414/23, 723; 901/29, 15, 9; 144/4.1, 144/34.1; 92/5 R; 294/82.15, 86.41; 403/31, 403/34; 401/34; 74/490.05, 490.06; 361/160; 212/242, 243, 251, 252, 259, 212/343, 344
See application file for complete search history.

(56) References Cited

U.S. PATENT DOCUMENTS

| | | | | | |
|---|---|---|---|---|---|
| 3,726,426 | A | * | 4/1973 | Tingskog | 414/626 |
| 3,908,695 | A | * | 9/1975 | Dunbar | 137/580 |
| 4,042,272 | A | | 8/1977 | Gotzen | |
| 4,063,107 | A | * | 12/1977 | Hartig | 307/106 |
| 4,083,463 | A | * | 4/1978 | Ericsson | 414/694 |
| 4,091,978 | A | * | 5/1978 | Graham, II | 225/100 |
| 4,124,047 | A | * | 11/1978 | Dressler et al. | 144/4.1 |
| 4,290,723 | A | * | 9/1981 | Johansson | 414/794.1 |
| 4,835,829 | A | * | 6/1989 | Welschof et al. | 29/894.361 |
| 4,989,652 | A | * | 2/1991 | Hansson | 144/34.1 |
| 5,046,468 | A | * | 9/1991 | Erhard | 123/406.54 |
| 5,046,916 | A | * | 9/1991 | Sorensen | 198/375 |
| 5,071,184 | A | | 12/1991 | Dessaux | |

(Continued)

FOREIGN PATENT DOCUMENTS

| | | |
|---|---|---|
| JP | 6156970 | 9/1994 |
| NL | 9301243 | 2/1995 |

(Continued)

*Primary Examiner* — Saul Rodriguez
*Assistant Examiner* — Glenn Myers
(74) *Attorney, Agent, or Firm* — Mark P. Stone

(57) ABSTRACT

The invention relates to a rotator (10) for jib-carried tools (1), for example tree working units, wherein the rotator (10) includes a stator (20) and a rotor (30), wherein the rotator (10) is connected to a tip (2) of the jib or arm (3) and to the tool (1). The rotator (10) has or includes in its surroundings means (70, 71) for determining the relative position of rotation between rotor (30) and stator (20). The means for determining the relative position of rotation comprises a pulse emitter (70) and a number of pulse generating elements (71), such as grooves or teeth. Limitation of the angle through which the rotator (10) can turn and control of the direction of rotation prevents, for instance, hoses and/or cables (7) from twisting or rotating away from their respective connections, while enhancing the extent to which automation can be achieved at the same time.

19 Claims, 3 Drawing Sheets

(56) References Cited

U.S. PATENT DOCUMENTS

| | | | | |
|---|---|---|---|---|
| 5,158,423 | A * | 10/1992 | Liljengren et al. | 198/750.11 |
| 5,445,197 | A * | 8/1995 | Larsson | 144/34.1 |
| 5,908,060 | A * | 6/1999 | Fargeot | 144/4.1 |
| 5,988,126 | A * | 11/1999 | Strauss et al. | 123/90.17 |
| 6,315,344 | B1 * | 11/2001 | Mattson et al. | 294/86.41 |
| 6,408,906 | B1 * | 6/2002 | Moon et al. | 144/24.13 |
| 6,474,146 | B2 * | 11/2002 | Okumura | 73/114.36 |

FOREIGN PATENT DOCUMENTS

| | | |
|---|---|---|
| SE | 9402227 | 12/1995 |
| WO | 9937136 | 7/1999 |
| WO | 0218714 | 3/2002 |

* cited by examiner

ROTATOR

The present invention relates to a rotator for co-action with jib-carried tools in accordance with the preamble of claim 1.

One serious problem experienced with rotators for co-action with tools carried on the ends of crane arms or jibs for instance, resides in the ability to orientate hoses and possibly also cables in a rational manner in respect of the driver of the vehicle. The driver must constantly be on his/her guard with regard to the choice of tool rotation, so as to avoid hose breakages. Externally disposed hose loops are vulnerable to damage and consequently a discrete or protected hose orientation is desirable.

One object of the present invention is to provide a rotator, which will significantly simplify the work required from the driver of the vehicle and that will also enable a high degree of automatisation to be achieved. This object is fulfilled by virtue of the invention having the characteristic features set forth in the claims.

The following advantages are examples of the many advantages that are afforded by the present invention.

The invention eliminates hose breakages and cable breakages as a result of wrong rotation of a tool, and also enables enhancement of automation so that the work of the driver will be simplified.

The inventive arrangement also affords both technical and economical advantages.

The invention will now be described in more detail with reference to an exemplifying embodiment thereof and also with reference to the accompanying drawings, in which FIG. 1 is a schematic side view of a so-called single-grip harvesting unit connected to a working arm or jib through the medium of an inventive rotator;

Figure 1:
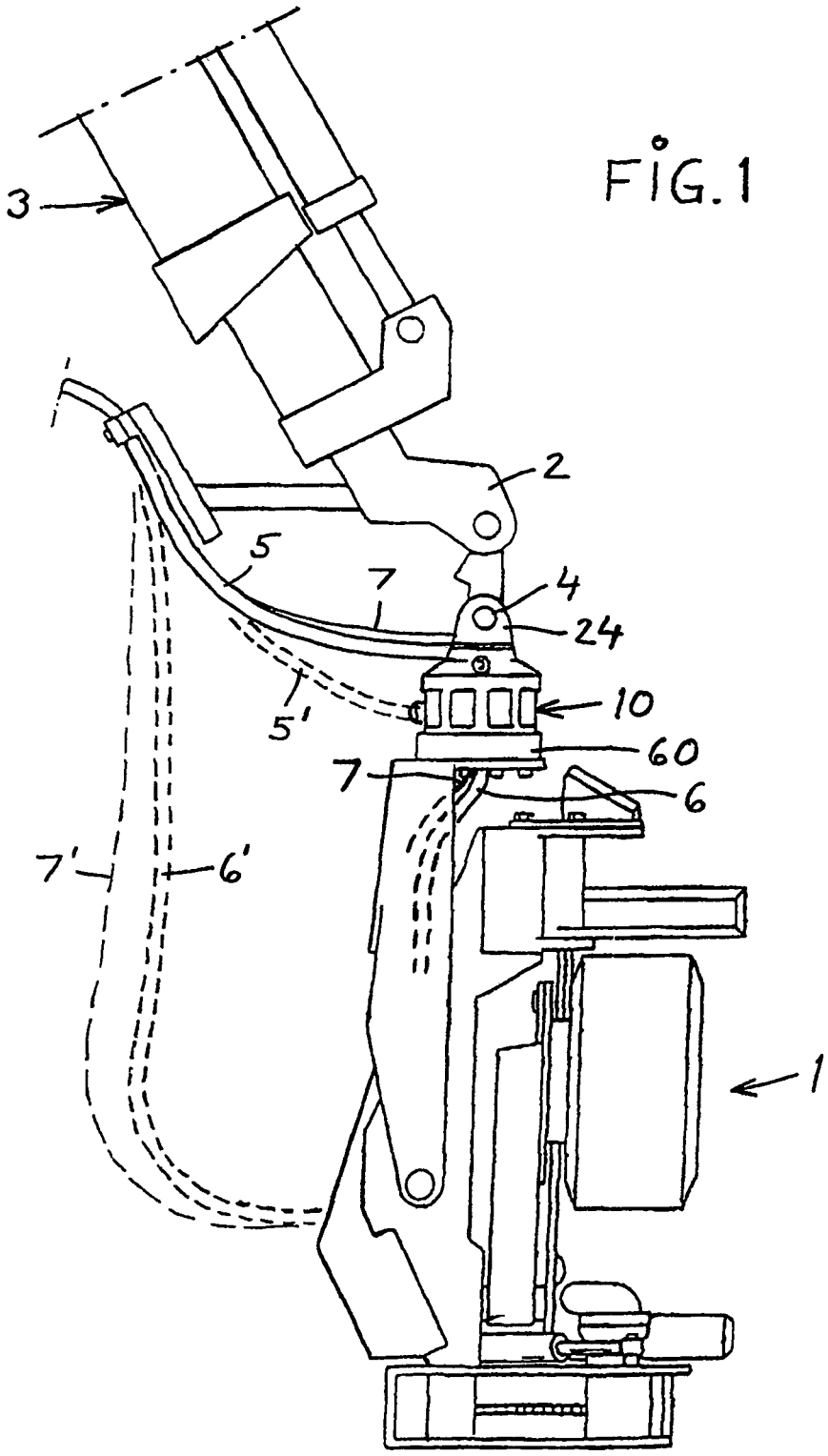

FIG. 1 illustrates a tool in the form of a so-called single-grip-harvesting unit 1 which is suspended from the tip 2 of a machine-carried jib/crane arm 3 through the medium of a rotator 10. The rotator 10 is suspended from a joint 4 or, e.g., from a swing damper that allows the tool 1 to swing relative to the tip of the jib/crane arm 3. The rotator 10 enables the tool 1 to be rotated relative to the tip 2 of the jib. Hydraulic medium (oil) is supplied to the rotator 10 and to the tool 1 through hoses 5. The connection of the hoses 5 to a vehicle-carried source of hydraulic medium is not shown in the figure.

Figure 2:
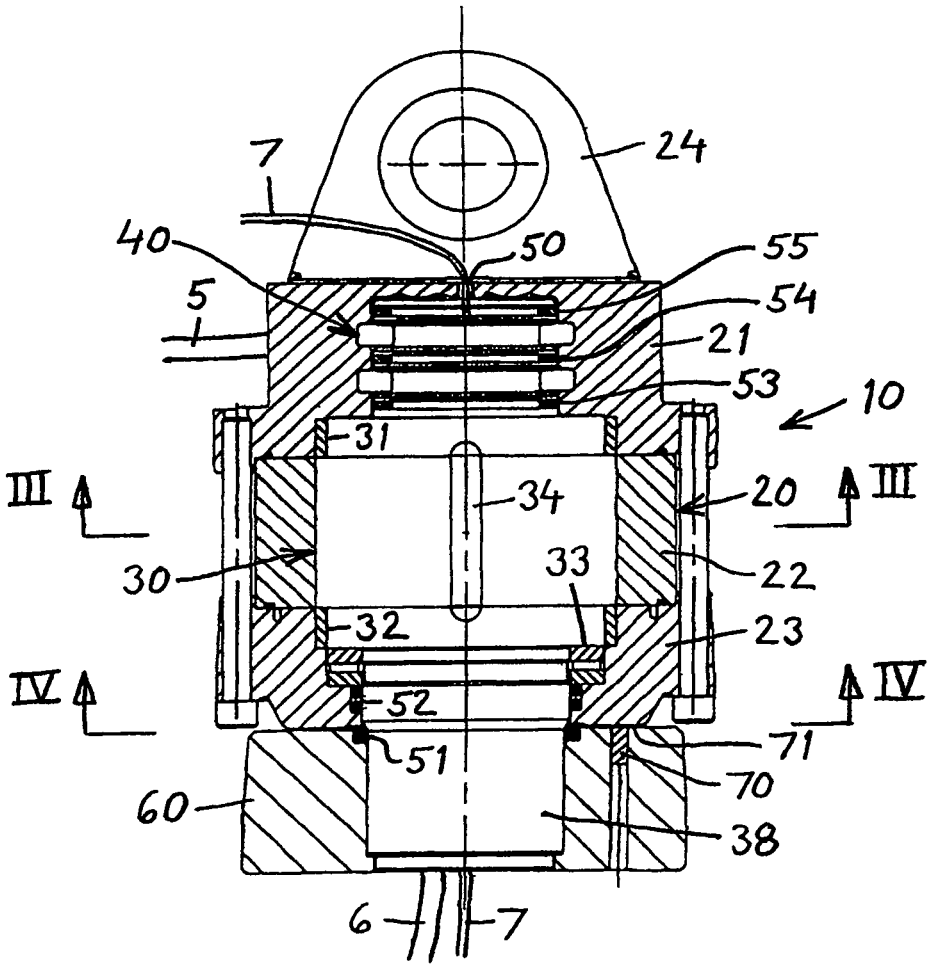
FIG. 2 is a vertically sectioned view of the rotator.
Figure 3:
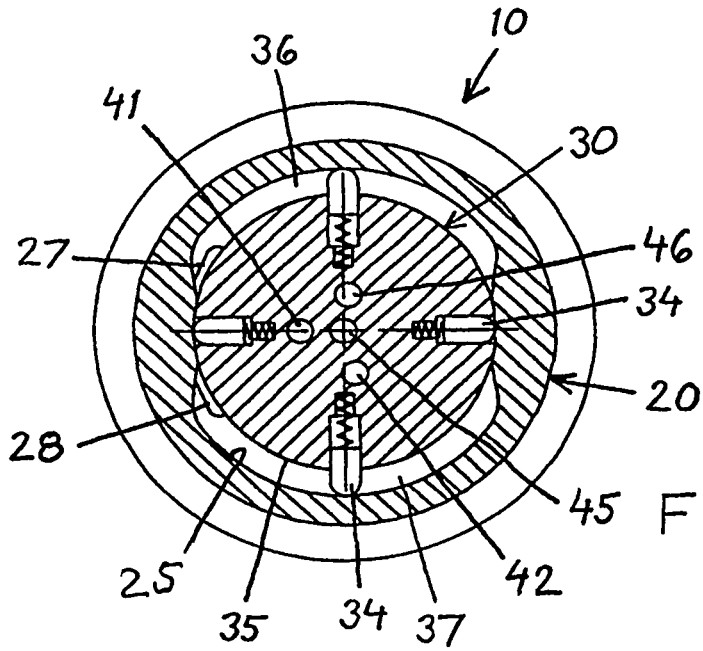
FIG. 3 is a sectional view of the rotator taken on the line III-III in FIG. 2.
Figure 4:
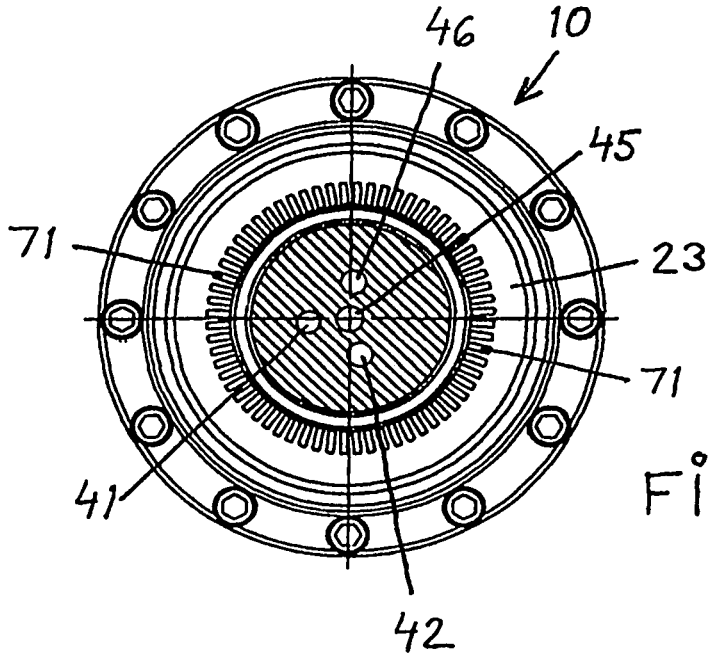
FIG. 4 is a sectional view of the rotator taken on the line IV-IV in FIG. 2.

As will be seen from FIGS. 2-4, the rotator 10 includes a stator 20 and a rotor 30. The stator 20 includes an upper stator wall 21, a stator ring 22 and a lower stator wall 23.

The upper stator wall 21 includes two attachment lugs 24 for attachment of the rotator 10 to the jib/arm 3.

The rotor 30 is mounted in the stator 20 and is rotatable relative to the stator 20 through the medium of two radial bearings 31,32 and one axial bearing 33. The illustrated rotor 10 is of the so-called wing type, wherewith spring-biased wings 34 on the rotor 30 define, together with the inner surface 25 of the stator and the outer surface 35 of the rotor, those working chambers 36,37 required for rotation of the rotator. The rotator has a multi-rotational and reversible rotational capacity.

In the case of the illustrated embodiment, the supply of hydraulic medium to the rotator is effected by coupling hydraulic hoses 5 to connection points on the upper stator wall 21, these connection points communicating with the working chambers 36,37 of the rotator via a number of channels (not shown) disposed in the stator wall 21. Although only two channels 27,28 are indicated in FIG. 3, it will be understood, of course, that further channels that lead to the working chambers are included.

Mounted at the upper end of the rotor 30 is a swivel coupling/swivel device 40 which enables hydraulic medium delivered to the rotator 10 (for instance via the hoses 5) to communicate with the tool 1. Hydraulic medium is transferred to a longitudinally extending channel 41 in the rotor 30 and to a longitudinally extending channel 42 in said rotor 30, via said swivel coupling. The channels 41 and 42 communicate with the tool 1, via hoses 6, so as to obtain the necessary supply of hydraulic medium. The hoses 6 obtain a highly discrete and protected orientation in relation to the tool 1, whilst following the rotational movement of the tool at the same time.

When the tool 1 requires an electric power supply or has communications requirements in the form of signal transmission or data transmission, the rotor 30 may include a through-passing transit hole, for instance a centre hole 45, through which the necessary electric cables and/or signal cables 7 can pass. In this regard, the upper stator wall 21 includes an opening 50 through which said cables can be drawn through the rotator. Further holes or channels 46 can be provided in the rotor 30 when necessary, for desired media transits or the like.

The rotator includes a number of seals 51-55 for preventing medium leakages.

The lower shaft end 38 of the rotor carries a non-rotatable clamping ring 60 which, in turn, carries the tool 1 so that rotational movement of the rotator will be transferred to said tool.

In the illustrated embodiment, the rotor 30 carries a so-called pulse emitter 70 which communicates with, e.g., a computer unit or processor (not shown) on the tool 1. The pulse emitter 70 of the illustrated embodiment is connected to the rotor 30 via the clamping ring 60 which accompanies the rotational movement of the rotor 30 and also the rotational movement of the tool 1. The lower stator wall 23 includes a number of grooves 71 which give rise to pulses from the pulse emitter 70 so as to enable the rotational position or twisting of the rotor 30 relative to the stator 20 to be mapped and monitored continuously.

Thus, according to the invention, the relative rotational position between rotor 30 and stator 20 can be determined with the aid of rotation indicating means 70,71. It is therewith possible to limit the angle through which the rotor rotates in both directions from a desired or chosen starting position/neutral position, so as to restrict rotational movement or twisting of, e.g., one or more connection cables 7 for signal transmission, the transmission of electric power, or the like. For example, the rotational ability of the rotor may be limited to about one revolution in either direction from a neutral starting position of the cable with respect to rotation or twisting of the cable.

When wishing to transmit the signals from the pulse emitter 70 to the vehicle or to the base machine, the pulse emitter is conveniently disposed at the stator or in its surroundings and the grooves or toothed elements are disposed at the rotor or its rotation-accompanying surroundings.

It will be understood that it lies within the scope of the invention to exchange the pulse emitter and indicators co-acting therewith for other alternative devices that are able to determine the relative position of rotation between rotor and stator.

It will also be understood that the orientation or drawing of the hoses and, when applicable, cables may be varied within the scope of invention. This has been exemplified by broken lines in FIG. 1. When desiring less discrete and protected hose orientation, pressure medium hoses 5' for rotator operation may be connected to the stator 20, while connecting pressure medium hoses 6' for tool operation directly to the tool 1 without passing the rotator 10. The rotator requires no swivel coupling 40 in this latter case.

The rotator swivel coupling 40 may also be excluded when the pressure medium hoses for tool operation are disposed through a transit hole extending longitudinally through the rotor 30, in the same way as the cable or cables 7.

As indicated in broken lines in FIG. 1, any signalling cable or electric cable 7' required may be placed externally.

It will be understood that the rotator drive principle and structural design may be varied widely within the scope of the present invention, and that the aforesaid wing drive may, for instance, be replaced by many other types of rotational drives. The drive medium used may, of course, also be varied.

A central feature of the invention resides in monitoring the rotational position of the rotator and limiting its rotation. This enables hoses and cables to be drawn, orientated, in a highly beneficial manner. The danger of hoses and cables subjected to torsion being twisted or wrenched away from their respective connections is also eliminated. The ability to monitor said rotational position promotes the possibility of significant automation.

The invention also enables the rotator to be monitored for undesirable rotational changes, so-called drifting, which when necessary can be eliminated by actively pressurising the working chambers of the rotator in an appropriate manner. The inventive arrangement is also able to for example actively control the braking sequence of the rotator.

Other variations are possible with regard to the connection of the rotator to the jib/arm and the tool. For example, the rotator may be modified structurally so that the rotor 30 is connected to the tip of the jib while the stator 20 is connected to the tool.

Instead of connecting the rotation indicating elements 70, 71 directly to the rotator, it lies within the scope of the invention to arrange said elements in the surroundings of the rotator, for instance if this is considered more suitable from a construction aspect.

As will be understood, limitation of the angle through which the rotator turns may be excluded when it is only desired to continuously map or determine the rotational/twisting position of the rotator.

The inventive arrangement can also be modified, of course, by exchanging the illustrated and described components for functionally equivalent components.

Thus, the invention is not restricted to the illustrated and described embodiment thereof, since modifications and variations can be made within the scope of the accompanying claims.

The invention claimed is:

1. A rotator for a jib-carried tool including tree working units, wherein the rotator (10) is hydraulically driven and includes a stator (20) and a rotor (30) and a source of hydraulic fluid applied to the rotor, and wherein said rotator (10) is connected to a tip (2) of the jib or arm (3) via a link arrangement and to said tool (1), characterized in that the rotator (10) or its surroundings includes a computer in communication with the rotor for determining the relative position of rotation between the rotor (30) and the stator (20) and for communicating with the source of hydraulic fluid applied to the rotor for limiting the extent of rotation of the rotor relative to the stator based upon said determined relative position for limiting twisting of attached hoses and/or cables and to enhance automation.

2. A rotator according to claim 1, characterised in that the computer for determining the relative position of rotation is in communication with a pulse emitter (70) and a number of pulse generating elements (71), including grooves or teeth.

3. A rotator according to claim 2, characterised in that the rotor (30) carries the pulse emitter (70) and that the stator (20) carries the pulse generating elements (71).

4. A rotator according to claim 3, characterised in that a supply (5) of pressure medium to the rotator is effected through the medium of connection points in the stator (20).

5. A rotator according to claim 3, characterised in that a supply of pressure medium to the tool (1) is effected through the medium of a swivel coupling (40) and through the medium of channels (41, 42) in the rotor (30).

6. A rotator according to claim 3, characterised in that a supply of pressure medium to the tool (1) is effected through the medium of at least one transit hole extending longitudinally through the rotor (30).

7. A rotator according to claim 3, characterised in that a supply of electric power and/or a supply of signals to the tool is effected through the medium of at least one transit hole (45) extending longitudinally through the rotor (30).

8. A rotator according to claim 2, characterised in that the stator (20) carries the pulse emitter (70) and that the rotor (30) carries the pulse generating elements (71).

9. A rotator according to claim 8, characterised in that a supply (5) of pressure medium to the rotator is effected through the medium of connection points in the stator (20).

10. A rotator according to claim 8, characterised in that a supply of pressure medium to the tool (1) is effected through the medium of a swivel coupling (40) and through the medium of channels (41, 42) in the rotor (30).

11. A rotator according to claim 8, characterised in that a supply of pressure medium to the tool (1) is effected through the medium of at least one transit hole extending longitudinally through the rotor (30).

12. A rotator according to claim 2, characterised in that a supply (5) of pressure medium to the rotator is effected through the medium of connection points in the stator (20).

13. A rotator according to claim 2, characterised in that a supply of pressure medium to the tool (1) is effected through the medium of at least one transit hole extending longitudinally through the rotor (30).

14. A rotator according to claim 2, characterised in that a supply of electric power and/or a supply of signals to the tool is effected through the medium of at least one transit hole (45) extending longitudinally through the rotor (30).

15. A rotator according to claim 2, characterised in that a supply of pressure medium to the tool (1) is effected through the medium of a swivel coupling (40) and through the medium channels (41, 42) in the rotor (30).

16. A rotator according to claim 1, characterised in that a supply (5) of pressure medium to the rotator is effected through the medium of connection points in the stator (20).

17. A rotator according to claim 1, characterised in that a supply of pressure medium to the tool (1) is effected through the medium of a swivel coupling (40) and through the medium of channels (41, 42) in the rotor (30).

18. A rotator according to claim 1, charactersized in that a supply of pressure medium to the tool (1) is effected through the medium of at least one transit hole extending longitudinally through the rotor (30).

19. A rotator according to claim 1, characterised in that a supply of electric power and/or a supply of signals to the tool is effected through the medium of at least one transit hole (45) extending longitudinally through the rotor (30).

* * * * *